US005821037A

United States Patent [19]

Twist et al.

[11] Patent Number: 5,821,037

[45] Date of Patent: Oct. 13, 1998

[54] PHOTOGRAPHIC DEVELOPER-AMPLIFIER COMPOSITION

[75] Inventors: Peter J. Twist, Gt. Missenden; Christopher J. Winscom, Pinner, both of United Kingdom

[73] Assignee: Eastman Kodak Company, Rochester, N.Y.

[21] Appl. No.: 816,289

[22] Filed: Mar. 13, 1997

[30] Foreign Application Priority Data

Mar. 13, 1996 [GB] United Kingdom ..... 9605244

[51] Int. Cl.[6] ..... G03C 7/407

[52] U.S. Cl. ..... 430/373; 430/444; 430/447; 430/490; 430/491; 430/943

[58] Field of Search ..... 430/467, 490, 430/491, 943, 373, 414, 447

[56] References Cited

U.S. PATENT DOCUMENTS

| | | | |
|---|---|---|---|
| 4,330,616 | 5/1982 | Kurematsu et al. | 430/376 |
| 4,880,725 | 11/1989 | Hirai et al. | 430/491 |

FOREIGN PATENT DOCUMENTS

| | | |
|---|---|---|
| 0 600 564 A | 6/1994 | European Pat. Off. . |
| 49020537B | 2/1974 | Japan . |

*Primary Examiner*—Hoa Van Le
*Attorney, Agent, or Firm*—J. Lanny Tucker

[57] ABSTRACT

A redox developer-amplifier composition contains a color developing agent and a redox oxidizing agent. The composition also contains a stabilizing amount of $Zn^{++}$ or $Mg^{++}$ ions, and thus has improved stability.

9 Claims, No Drawings

PHOTOGRAPHIC DEVELOPER-AMPLIFIER COMPOSITION

FIELD OF THE INVENTION

This invention relates to photographic developer-amplifier compositions for use in redox amplification processes.

BACKGROUND OF THE INVENTION

Redox (RX) amplification processes have been described, for example in British Specification Nos. 1,268,126; 1,399,481; 1,403,418 and 1,560,572. In such processes, color materials are developed to produce a silver image (which may contain only small amounts of silver) and then treated with a redox amplifying solution (or a combined developer-amplifier) to form a dye image.

The developer-amplifier solution contains a color developing agent and a redox oxidizing agent that will oxidize the color developing agent in the presence of the silver image that acts as a catalyst.

Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide and compounds that provide hydrogen peroxide, e.g., addition compounds of hydrogen peroxide; cobalt (III) complexes including cobalt hexammine complexes; and periodates. Mixtures of such compounds can also be used.

Because a developer-amplifier solution contains both a reducing agent (developing agent) and an oxidant, they can react together spontaneously thus leading to very poor solution stability. This leads to a failure to provide the desired dye density on processing. It is this phenomenon in particular that has inhibited commercial use of the RX process.

U.S. Pat. No. 4,330,616 discloses that the use of water-soluble metal salts (including zinc and magnesium), together with a diphosphonic acid, will inhibit the loss of hydroxylamine in a color developing solution. There is no mention of developer-amplifier solutions additionally containing a redox oxidant. Example 6 below shows that this combination does not satisfactorily stabilize a developer-amplifier solution.

Although a number of solutions to the problem of stability have been proposed, there is a constant need to improve the stability of developer-amplifier compositions.

SUMMARY OF THE INVENTION

According to the present invention there is provided a redox developer-amplifier composition comprising a color developing agent, a redox oxidizing agent, and a stabilizing amount of $Zn^{++}$ or $Mg^{++}$ ions.

This invention also provides a method of processing color photographic silver halide materials by treating the materials with the composition described above.

It has been found that the inclusion of $Zn^{++}$ or $Mg^{++}$ ions in RX developer-amplifier solutions reduces the instability of the solution and thus the density loss in the processed photographic material that occurs upon aging of the solution, for example, when the processing machine in which it is contained is standing idle.

DETAILED DESCRIPTION OF THE INVENTION

The redox amplification oxidant (or oxidizing agent) may be a persulfate, periodate, Cobalt(III) compound or, preferably, a peroxide. Examples of suitable peroxide oxidizing agents are peroxy compounds including hydrogen peroxide and compounds that provide hydrogen peroxide, e.g., addition compounds of hydrogen peroxide.

Other components that may be included in a developer-amplifier solution include a base, e.g., potassium or sodium hydroxide; a pH buffer such as a carbonate, borate, silicate or phosphate; antioxidants such as hydroxylamine sulfate, diethylhydroxylamine; metal-chelating compounds such as 1-hydroxyethylidene-1,1'-diphosphonic acid, catechol disulfonate and diethyltriaminepentaacetic acid.

The present processing solutions may be any of those described in *Research Disclosure,* Item 36544, September 1994, Sections XVII to XX, published by Kenneth Mason Publications, Emsworth, Hants, United Kingdom.

As indicated above, the developer-amplifier solution may also contain hydroxylamine as an additional preservative. The purpose for this is to protect the color developing agent against aerial oxidation. It is preferably used as a salt thereof such as hydroxylamine chloride, phosphate or, preferably, sulfate. The amount used is from 0.05 to 10 g/l, preferably from 0.1 to 5.0 g/l and, especially, from 0.4 to 2.0 g/l [as hydroxylamine sulfate (HAS)].

The pH is preferably buffered, e.g., by a phosphate such as potassium hydrogen phosphate ($K_2HPO_4$) or by another phosphate, or carbonate, silicate or mixture thereof. The pH may be in the range from 10.5 to 12, preferably in the range from 11 to 11.7 and especially from 11 to 11.4.

The zinc ions may be provided by a zinc compound. Examples of zinc compounds that may be used are: zinc sulfate, zinc chloride, zinc hydroxide, zinc nitrate, and zinc acetate. The magnesium ions may be provided by an analogous set of compounds.

Such compounds often have limited water solubility at higher pH values. Hence, it is preferred to solubilize the $Zn^{++}$ or $Mg^{++}$ ions by means of a chelating agent, for example, a polycarboxylic chelating agent (such as polyaminocarboxylic acid). An example of a suitable chelating agent is diethylenetriaminepentaacetic acid (DTPA).

DTPA is often used in developer-amplifier compositions to stabilize the hydroxylamine compound and the hydrogen peroxide against decomposition catalyzed by metal ions such as iron, copper and manganese. Hence, if it is used to chelate the zinc ions, the amount used should be in addition to that necessary to stabilize the hydroxylamine.

The preferred concentration range of the zinc ions (as zinc sulfate heptahydrate) is from 0.1 to 20 g/l, preferably from 0.5 to 10 g/l and especially from 1 to 5 g/l. Amounts of chelating agent needed to solubilize the zinc ions will be the molar equivalent amounts. Amounts of DTPA, for example, will be from 0.14 to 27.4 g/l, preferably from 0.7 to 14 g/l and especially from 1.4 to 6.8 g/l.

The concentration range of the hydrogen peroxide is preferably from 0.1 to 20 ml/l and especially from 0.5 to 2 (as 30% w/w solution).

The composition is preferably free of any compound that forms a dye on reaction with oxidized color developing agent.

The redox amplification solution preferably contains, dissolved in the solution, a compound having a hydrophobic hydrocarbon group and a group that adsorbs to silver or stainless steel solubilized, if necessary, with a non-ionic water-soluble surfactant. Examples of such compounds are alkyl amines, alkylaryl amines, secondary and tertiary alkyl amines, alkyl quaternary salts, alkyl heterocyclic quaternary salts, alkyl amino carboxylic acids, alkyl amino sulfonic acids, alkyl diamines, branched alkyl diamines, alkyl thiols, alkyl thiocarboxylic acids, and alkyl thiosulfonic acids. An especially preferred compound is dodecylamine.

A particular application of this invention is in the processing of silver chloride color paper, for example paper comprising at least 85 mole percent silver chloride, especially such paper having total silver levels from 5 to 700 $mg/m^2$, and for image amplification applications, levels from 10 to 120 $mg/m^2$ and particularly from 15 to 60 $mg/m^2$.

Such color materials can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

While the present solutions may be used in conventional large scale or minilab processing environments, the present processing solutions are preferably used in a method of processing carried out by passing the material to be processed through a tank containing the processing solution which is recirculated through the tank at a rate of from 0.1 to 10 tank volumes per minute.

The preferred recirculation rate is from 0.5 to 8, especially from 1 to 5, and particularly from 2 to 4 tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence, in a preferred embodiment of the present invention, the ratio of tank volume to maximum area of material that can be accommodated in the tank is less than 25 $dm^3/m^2$, and preferably less than 11 $dm^3/m^2$, more preferably, less than 5 $dm^3/m^2$, and most preferably less than 3 $dm^3/m^2$.

By 'tank volume' or 'processing solution volume' is meant the volume of the solution within the processing tank/channel together with that of the associated recirculation system, which includes, for example, pipework, valves, pumps, filter housings etc.

By 'maximum area of the material which can be accommodated in the tank', or immersed in the solution, is meant the product of the maximum width of the material processed and the path length taken by the material through the processing solution within the tank.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 3 mm. The shape of the tank is not critical but it could be in the shape of a shallow tray or preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total volume of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leqq F/A \leqq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems are described in more detail in the following patent specifications:

U.S. Pat. No. 5,294,956, EP-A-559,027, U.S. Pat. No. 5,179,404, EP-A-559,025, U.S. Pat. No. 5,270,762, EP-A-559,026, WO 92/10790, WO 92/17819, WO 93/04404, WO 92/17370, WO 91/19226, WO 91/12567, WO 92/07302, WO 93/00612, WO 92/07301, WO 92/09932 and U.S. Pat. No. 5,436,118.

The following Examples are included for a better understanding of the invention.

EXAMPLE 1

Some developer solutions were prepared to compare the effects with and without $Zn^{2+}$ ion. $Zn^{2+}$ is not soluble in phosphate solution at pH 11.4 and so an additional complexing agent was added to maintain it in solution. Diethylenetriaminepentaacetic acid (DTPA) is used to protect against $Mn^{2+}$ catalyzed decomposition of the RX developer and DTPA is a good sequestrant for $Zn^{2+}$. In view of this, it was used equimolar with the $Zn^{2+}$ ion since it forms a 1:1 complex. There was an excess of DTPA equal to the original level used to protect against $Mn^{2+}$ ion. The total $Zn^{2+}$ level was equimolar with HAS level. It is thought that hydroxylamine will form a mixed complex such as Zn/DTPA/HAS in equilibrium with hydroxylamine sulfate in solution. The developers are shown in Table 1.

TABLE 1

Developer-amplifier Composition

| Component | Composition Dev 1 | Dev 2 | Dev 3 |
|---|---|---|---|
| AC5 | 0.6 g/l | — | —> |
| DTPA | 0.81 g/l | — | —> |
| $K_2HPO_4.3H_2O$ | 40 g/l | — | —> |
| KBr | 1 mg/l | — | —> |
| KCl | 0.5 g/l | — | —> |
| CDS | 0.3 g/l | — | —> |
| HAS | 1.0 g/l | — | —> |
| KOH(50%) | 10 ml/l | — | —> |
| CD3 | 4.5 g/l | — | —> |
| TWEEN 80 | 0.8 g/l | — | —> |
| Dodecylamine | 0.1 g/l | — | —> |
| $H_2O_2$(30%) | 2.0 ml/l | — | —> |
| pH | 11.4 | — | —> |
| $ZnSO_4.7H_2O$ | 0 | 3.45 g/l | 0 |
| DTPA | 0 | 4.72 g/l | 4.72 g/l |

AC5 is a 60% solution of 1-hydroxyethylidene-1,1-diphosphonic acid, DTPA is a 41% solution of the penta sodium salt of diethylenetriaminepentaacetic acid, CDS is catechol disulfonate, TWEEN 80 is a Trade Mark of Atlas Chemical Industries Inc. and is a non ionic surfactant. The Zn and DTPA were equimolar at $1.2\times10^{-2}$ m so that all the excess DTPA is used to complex the Zn. These developers were monitored over a period of days with sensitometric strips with photographic silver halide color paper having a total silver coating weight of 62 mg/m$^2$. The complete process cycle was as follows:

Dev/amp 45 seconds

Fix 45 seconds

Wash 2 minutes

Dry air

The Fixer was:

Glacial acetic acid 20 ml/l

NaOH solid 2 g/l

Sodium sulfite 50 g/l

Sodium thiosulfate 20 g/l pH 6.0

The results of these standing tests in terms of neutral Dmax are shown in Table 2 below.

TABLE 2

Standing Tests (Dmax × 100)

| Age | Dev 1 | | | Dev2 | | | Dev 3 | | |
|---|---|---|---|---|---|---|---|---|---|
| (hrs) | R | G | B | R | G | B | R | G | B |
| 0 | 225 | 237 | 226 | 241 | 230 | 218 | 207 | 213 | 218 |
| 24 | 225 | 247 | 220 | 223 | 226 | 215 | 101 | 115 | 110 |
| 48 | 242 | 242 | 222 | 221 | 221 | 208 | 75 | 74 | 76 |
| 120 | 243 | 240 | 202 | 247 | 229 | 203 | 63 | 64 | 72 |
| 162 | 264 | 232 | 204 | 255 | 232 | 205 | | | |
| 209 | 93 | 97 | 105 | 176 | 165 | 167 | | | |
| 282 | 63 | 66 | 75 | 62 | 64 | 75 | | | |

It can be seen that Dev 2 maintains Dmax better than Dev 1; for example, the loss in density up to 209 hours is 132(R), 140(G) and 121(B) without Zn and 65(R), 65(G) and 51(B) with Zn. Dev 3 that contains the extra DTPA but no Zn, is now considerably less stable than either Dev 1 or Dev 2. Thus, it is clear that Zn not only prevents the extra DTPA from causing decomposition but the combination is more stable than the control (Dev 1).

EXAMPLE 2

A procedure similar to that in Example 1 was repeated using a different source of DTPA. In this case, it was a 40% solution of the penta sodium salt at 5.83 ml/l. In addition, the $ZnSO_4$/DTPA-$Na_5$ was at $6\times10^{-3}$ molar, which is equivalent to 1.72 g/l $ZnSO_4$. Excess DTPA-$Na_5$ at 2.0 ml/l equivalent to 0.81 g/l DTPA was used to maintain protection against $Mn^{2+}$. The results are shown in Table 3, where Dev 5 contains the added Zn/DTPA-$Na_5$ and Dev 4 is the same as Developer 1 but with the 40% solution as the DTPA source.

TABLE 3

Standing Tests (Dmax × 100)

| Age | Dev 4 | | | Dev 5 | | |
|---|---|---|---|---|---|---|
| (hrs) | R | G | B | R | G | B |
| 0 | 267 | 255 | 244 | 265 | 260 | 244 |
| 18 | 256 | 254 | 237 | 252 | 256 | 226 |
| 47 | 248 | 244 | 222 | 268 | 249 | 225 |
| 95 | 251 | 243 | 217 | 243 | 248 | 205 |
| 163 | 260 | 244 | 205 | 255 | 231 | 198 |
| 189 | 249 | 220 | 199 | 264 | 233 | 198 |
| 213 | 171 | 159 | 165 | 214 | 202 | 187 |
| 231 | 112 | 109 | 116 | 147 | 146 | 147 |

Here the density changes over 231 hours are Dev 4, R 155, G 146 and B 128; Dev 5, R 108, G 114 and B 97 which again shows that Zn/DTPA reduces density loss. In this case the effect is smaller than in Example 1 probably because of the lower Zn level.

EXAMPLE 3

A procedure similar to that in Example 2 was performed using the same source of DTPA. The $ZnSO_4$/DTPA-$Na_5$ was at $6\times10^{-3}$ molar, and an additional excess of DTPA-$Na_5$ equivalent to 0.81 g/l DTPA was used as in Example 2. Dev 6 is without the $ZnSO_4$/DTPA-$Na_5$, Dev 7 is with $ZnSO_4$/DTPA-$Na_5$, and Dev 8 is identical to 7 with an increased HAS level (+40%). All solutions were prepared with the same peroxide level used in the Dev solutions of Example 2. The temperature of the solutions was maintained at 37° C.

Here the initial rate of dye formation in a single red-sensitized layer was used as a measure of the developer activity, rather than sensitometry. Initial rates are more sensitive to activity change than sensitometric measures. The results are shown in Table 4.

TABLE 4

Standing Tests ($s^{-1}$)

| Age (hrs) | Dev 6 R | Dev 7 R | Dev 8 R |
|---|---|---|---|
| 1 | 0.076 | 0.072 | 0.058 |
| 17 | 0.072 | 0.072 | 0.053 |
| 24 | 0.088 | 0.080 | 0.053 |
| 41 | 0.072 | 0.064 | 0.064 |
| 47 | 0.088 | 0.080 | 0.064 |
| 65 | 0.088 | 0.064 | 0.058 |
| 72 | 0.064 | 0.064 | 0.064 |
| 89 | 0.019 | 0.041 | 0.048 |
| 96 | 0.015 | 0.017 | 0.039 |

The losses in activity after 89 hours are Dev 6 0.057 $s^{-1}$, Dev 7 0.031 $s^{-1}$, and Dev 8 0.010 $s^{-1}$. Dev 6 collapses completely beyond 90 hours, while the solutions containing $ZnSO_4$/DTPA-$Na_5$ show much smaller changes in activity and longer overall lifetimes. The lower initial activity exhibited by Dev 8 is caused by the increased amount of HAS.

EXAMPLE 4

TABLE 5

| Developer-amplifier Composition | | | |
|---|---|---|---|
| | Composition | | |
| Component | Dev 9 | Dev 10 | Dev 11 |
| AC5 | 0.6 g/l | — | —> |
| DTPA | 0.81 g/l | — | —> |
| $K_2HPO_4.3H_2O$ | 40 g/l | — | —> |
| KBr | 1 mg/l | — | —> |
| KCl | 0.5 g/l | — | —> |
| CDS | 0.3 g/l | — | —> |
| HAS | 1.5 g/l | 1.5 g/l | 1.5 g/l |
| KOH(50%) | 10 ml/l | — | —> |
| CD3 | 4.5 g/l | — | —> |
| TWEEN 80 | 0.8 g/l | — | —> |
| Dodecylamine | 0.1 g/l | — | —> |
| $H_2O_2$(30%) | 2.0 ml/l | 3.0 ml/l | 3.0 ml/l |
| pH | 11.4 | — | —> |
| $ZnSO_4.7H_2O$ | 3.45 g/l | 3.45 g/l | 0 |
| DTPA | 4.72 g/l | 4.72 g/l | 0 |

These developer-amplifiers were made up with increased HAS and, apart from this change, Dev 9 is the same as Dev 2 in Table 1. The other two developers had increased peroxide level to compensate for the loss of initial activity caused by increased HAS. Dev 10 is with Zn/DTPA and Dev 11 is without Zn/DTPA. The standing tests were carried out as in the first example. The results are shown in Table 6.

TABLE 6

| Standing Tests (Dmax × 100) | | | | | | | | | |
|---|---|---|---|---|---|---|---|---|---|
| Age | Dev 9 | | | Dev 10 | | | Dev 11 | | |
| (hrs) | R | G | B | R | G | B | R | G | B |
| 0 | 153 | 180 | 165 | 267 | 261 | 245 | 253 | 258 | 242 |
| 24 | 147 | 163 | 157 | 248 | 239 | 221 | 260 | 251 | 230 |
| 48 | 144 | 170 | 155 | 231 | 245 | 208 | 250 | 245 | 220 |
| 120 | 167 | 175 | 166 | 240 | 235 | 178 | 276 | 249 | 194 |
| 168 | 192 | 191 | 176 | 265 | 233 | 180 | 273 | 241 | 178 |
| 192 | 206 | 208 | 177 | 263 | 237 | 186 | 243 | 209 | 172 |
| 216 | 205 | 190 | 174 | 202 | 173 | 160 | 128 | 126 | 127 |
| 280 | 66 | 69 | 76 | 60 | 64 | 73 | 60 | 62 | 73 |

The low starting densities of Dev 9 are compensated for by the increased peroxide in Dev 10 and the overall lifetime is about the same for these two developers. The overall lifetime with increased HAS (1.5 g/l compared with 1.0 g/l) is greater; compare Dev 11 with Dev 1, but the improvement with Zn is still maintained; compare Dev 10 (with Zn) to Dev 11 (without Zn). Here the density loss up to 216 hours is Dev 11, R 125, G 132 and B 115; and Dev 10, R 65, G 88 and B 85. The density loss in the red is halved in the presence of Zn.

EXAMPLE 5

It is the purpose of this example to show that the presence of a diphosphonic acid is not necessary for the present invention.

In U.S. Pat. No. 4,330,616, Kurematsu et al show a developer with a diphosphonic acid and metal ions, such as zinc and magnesium, that does not have precipitates and also has improved stability of hydroxylamine and color developing agent. In our previous examples a diphosphonic acid is present at 0.6 g/l of a 60% aqueous solution of 1-hydroxyethylidene-1,1-diphosphonic acid. This is a level used in current commercial non-RX developers. It is present as an anti-calcium agent and is also useful to prevent the catalytic properties of heavy metal ions such as iron ions in decomposing developer solutions. It is present for the same reasons in our RX developer-amplifier formulation. Some developer compositions are shown below which do not contain a diphosphonic acid but still show the improved stability in the presence of zinc ions.

TABLE 7

| Developer Composition | | | |
|---|---|---|---|
| | Composition | | |
| Component | Dev 12 | Dev 13 | Dev 14 |
| DTPA | 0.81 g/l | — | —> |
| $K_2HPO_4.3H_2O$ | 40 g/l | — | —> |
| KBr | 1 mg/l | — | —> |
| KCl | 0.5 g/l | — | —> |
| CDS | 0.3 g/l | — | —> |
| HAS | 1.0 g/l | — | —> |
| KOH(50%) | 10 ml/l | — | —> |
| CD3 | 4.5 g/l | — | —> |
| TWEEN 80 | 0.8 g/l | — | —> |
| Dodecylamine | 0.1 g/l | — | —> |
| $H_2O_2$(30%) | 2.0 ml/l | — | —> |
| pH | 11.4 | — | —> |
| $ZnSO_4.7H_2O$ | 3.45 g/l | 0 | 0 |
| $MgSO_47H_2O$ | 0 | 2.96 g/l | 0 |
| DTPA | 4.72 g/l | 4.72 g/l | 4.72 g/l |
| Time | 45 seconds | — | —> |
| Temperature | 35° C. | — | —> |

These developers were kept over a period of time as in previous examples and monitored by means of control strips at intervals. The Dmax values as a function of developer age are shown in Table 8 below.

TABLE 8

| The effect of zinc and magnesium in the absence of diphosphonic acid Standing Tests (Dmax × 100) | | | | | | | | | |
|---|---|---|---|---|---|---|---|---|---|
| Age | Dev 12 | | | Dev 13 | | | Dev 14 | | |
| (hrs) | R | G | B | R | G | B | R | G | B |
| 0 | 252 | 230 | 228 | 272 | 245 | 235 | 263 | 254 | 234 |
| 21 | 241 | 220 | 215 | 219 | 216 | 208 | 86 | 85 | 83 |
| 47 | 229 | 216 | 212 | 178 | 179 | 176 | 64 | 65 | 67 |
| 72 | 242 | 221 | 215 | 165 | 153 | 165 | 61 | 62 | 67 |
| 96 | 239 | 225 | 212 | 168 | 147 | 155 | 60 | 61 | 67 |
| 168 | 265 | 233 | 213 | 134 | 122 | 136 | 63 | 63 | 70 |
| 192 | 243 | 218 | 198 | 124 | 110 | 131 | 60 | 62 | 67 |
| 208 | 154 | 138 | 156 | 108 | 104 | 122 | 61 | 63 | 67 |
| 232 | 84 | 81 | 94 | 81 | 80 | 99 | 68 | 68 | 78 |

It can be seen from these data that zinc and magnesium ions improve the stability of the RX developer even though a diphosphonic acid is absent. Developers 12 and 13 are more stable than developer 14 that is the same but does not contain added zinc or magnesium ions.

EXAMPLE 6

The effect of magnesium ions with a diphosphonic acid

This example shows that the improvement in stability for a conventional developer shown by Kurematsu et al in the presence of a diphosphonic acid and metal ions, such as magnesium, does not occur with RX developers of the current formula.

TABLE 9

| Developer Composition | | | |
|---|---|---|---|
| | Composition | | |
| Component | Dev 15 | Dev 16 | Dev 17 |
| AC5 | 0.6 g/l | 5.1 g/l | 5.1 g/l |
| DTPA | 0.81 g/l | — | —> |
| $K_2HPO_4.3H_2O$ | 40 g/l | — | —> |
| KBr | 1.5 mg/l | — | —> |
| KCl | 0.45 g/l | — | —> |
| CDS | 0.3 g/l | — | —> |
| HAS | 1.2 g/l | — | —> |
| KOH(50%) | 10 ml/l | — | —> |
| CD3 | 5.5 g/l | — | —> |
| TWEEN 80 | 0.3 g/l | — | —> |
| Dodecylamine | 0.1 g/l | — | —> |
| H2O2(30%) | 2.5 ml/l | — | —> |
| pH | 11.5 | — | —> |
| $MgSO_47H_2O$ | 0 | 0 | 3.59 g/l |
| Time | 45 seconds | | |

The results for standing tests on these developers are shown in table 10 below.

TABLE 10

| The effect of magnesium and diphosphonic acid Standing Tests (Dmax × 100) | | | | | | | | | |
|---|---|---|---|---|---|---|---|---|---|
| Age | Dev 15 | | | Dev 16 | | | Dev 17 | | |
| (hrs) | R | G | B | R | G | B | R | G | B |
| 0 | 286 | 258 | 259 | 280 | 263 | 257 | 290 | 263 | 260 |
| 22 | 274 | 253 | 243 | 289 | 267 | 251 | 281 | 264 | 253 |
| 46 | 265 | 252 | 243 | 277 | 271 | 260 | 285 | 253 | 250 |
| 112 | 276 | 251 | 239 | 287 | 253 | 239 | 283 | 261 | 245 |
| 160 | 244 | 216 | 214 | 270 | 243 | 228 | 206 | 189 | 199 |
| 184 | 133 | 126 | 142 | 195 | 175 | 185 | 91 | 91 | 105 |

Developer 15 is with our standard level of the diphosphonic acid and Developer 16 has the increased level used by Kurematsu et al but without any added magnesium ions whereas Developer 17 has the increased level of the diphosphonic acid with equimolar magnesium ions. It can be seen that although increased diphosphonic acid improves developer lifetime; magnesium ions lower developer lifetime.

The invention has been described in detail with particular reference to preferred embodiments thereof, but it will be understood that variations and modifications can be effected within the spirit and scope of the invention.

We claim:

1. A redox developer-amplifier composition having a pH of from 11 to 12, and comprising a color developing agent in an amount of from 0.1 to 10 g/l, a redox oxidizing agent that is hydrogen peroxide in an amount of from 0.1 to 20 ml/l of a 30% solution of hydrogen peroxide, $Zn^{++}$ or $Mg^{++}$ ions in an amount of from 0.1 to 20 g/l, a hydroxylamine in an amount of from 0.05 to 10 g/l, and a polycarboxylic acid chelating agent to solubilize said $Zn^{++}$ or $Mg^{++}$ ions, said chelating agent present in an amount of from 0.1 to 30 g/l.

2. The composition of claim 1 wherein said chelating agent is diethylenetriamine-pentaacetic acid.

3. The composition of claim 1 wherein said $Zn^{++}$ or $Mg^{++}$ ions are provided by zinc sulfate, zinc chloride, zinc hydroxide, zinc nitrate, or zinc acetate.

4. The composition of claim 1 which is an aqueous solution.

5. A method of processing a color photographic silver halide material comprising treating said material with the composition of claim 1.

6. The method of claim 5 wherein said photographic silver halide material is a silver chloride color paper.

7. The method of claim 6 wherein said color paper contains from 5 to 700 mg silver per $m^{2.}$

8. The method of claim 7 wherein said color paper contains from 10 to 120 mg silver per $m^{2.}$

9. The method of claim 6 wherein said material has at least one emulsion comprising at least 85 mol % silver chloride.

* * * * *